US010624437B1

(12) United States Patent
Green

(10) Patent No.: US 10,624,437 B1
(45) Date of Patent: Apr. 21, 2020

(54) SHOULDER STRAP ASSEMBLY FOR A BAG

(71) Applicant: Kimberly Ann Green, Lenoir City, TN (US)

(72) Inventor: Kimberly Ann Green, Lenoir City, TN (US)

( * ) Notice: Subject to any disclaimer, the term of this patent is extended or adjusted under 35 U.S.C. 154(b) by 0 days.

(21) Appl. No.: 16/693,843

(22) Filed: Nov. 25, 2019

Related U.S. Application Data

(60) Provisional application No. 62/900,027, filed on Sep. 13, 2019.

(51) Int. Cl.

| | |
|---|---|
| ***A45C 3/00*** | (2006.01) |
| ***A45C 3/06*** | (2006.01) |
| ***A45F 3/00*** | (2006.01) |
| ***B65D 30/00*** | (2006.01) |
| ***B65D 33/06*** | (2006.01) |
| ***A45F 3/02*** | (2006.01) |
| ***A45C 13/30*** | (2006.01) |
| *A45C 13/00* | (2006.01) |
| *B65D 33/10* | (2006.01) |
| *A45C 1/02* | (2006.01) |
| *A45C 13/26* | (2006.01) |

(52) U.S. Cl.
CPC ..... *A45F 3/02* (2013.01); *A45C 13/30* (2013.01); *A45C 1/02* (2013.01); *A45C 3/06* (2013.01); *A45C 13/001* (2013.01); *A45C 13/26* (2013.01); *B65D 29/00* (2013.01); *B65D 33/105* (2013.01)

(58) Field of Classification Search
CPC .... A45F 3/02; A45C 1/02; A45C 3/04; A45C 3/06; A45C 13/26; B65D 33/105; B65D 29/00
USPC ..... 224/612; D3/232, 243
See application file for complete search history.

(56) References Cited

U.S. PATENT DOCUMENTS 1,400,499 A * 12/1921 Henderson ..... A45C 3/04 383/18
1,729,318 A * 9/1929 Wunderlich ..... A45C 3/04 383/2
1,916,793 A * 7/1933 Harper ..... A45C 13/26 294/149
2,532,778 A * 12/1950 Mintzes ..... A45C 3/04 383/40
3,227,338 A * 1/1966 Hall ..... A45F 5/00 224/602
3,353,741 A * 11/1967 Kamins ..... A45C 13/26 383/15

(Continued)

*Primary Examiner* — Justin M Larson
(74) *Attorney, Agent, or Firm* — Dunlap Bennett & Ludwig PLLC

(57) ABSTRACT

A shoulder strap assembly for shoulder-supported bags is provided. The shoulder strap assembly is manufactured to provide a tri-para-planar alignment of the strap and the folded body material that forms the enclosure of the bag. The folded body material includes a coextensive flap portion that folds over an opening of the enclosure. When folded over, the flap portion twists each fixed end of the shoulder strap, in opposite directions. The twist amounts to rotation of approximately ninety degrees of each fixed distal end relative to the shoulder strap's curved apex/midpoint. As a result, a predetermined curvature if formed at the apex of the shoulder strap material. This predetermined curvature causes the shoulder bag to pull and/or lean toward the body of the wearer, preventing the associated shoulder bag from falling off the shoulder.

5 Claims, 4 Drawing Sheets

(56) References Cited

U.S. PATENT DOCUMENTS 3,710,391 A 1/1973 McGlynn
3,831,649 A * 8/1974 Whittaker ..... A45C 3/04 224/602
4,017,944 A 4/1977 Cohen
4,040,147 A 8/1977 King
4,125,904 A 11/1978 Levine
4,164,308 A * 8/1979 Gautier ..... A45C 13/18 150/109
4,811,768 A * 3/1989 Williams ..... A45C 1/04 150/102
4,811,876 A 3/1989 Riggi
4,879,768 A 11/1989 McClees et al.
4,989,656 A * 2/1991 Derfler ..... A45C 3/00 150/108
5,127,536 A * 7/1992 Cohen ..... A45C 3/04 150/102
5,292,044 A 3/1994 Reimers
5,666,701 A 9/1997 Drummond
5,881,788 A * 3/1999 Hersh ..... A45C 3/06 150/116
6,109,678 A * 8/2000 Esfandiari ..... A45C 13/22 294/137
6,467,661 B1 10/2002 Mistretta et al.
6,925,656 B2 8/2005 Henderson
7,246,643 B2 * 7/2007 Andrews ..... A45C 3/08 150/103
D599,545 S * 9/2009 Nelson ..... A45C 1/024 D3/232
7,725,958 B1 6/2010 Gilmore
7,926,525 B2 * 4/2011 Vaccarella ..... A45C 13/26 150/104
8,061,896 B2 * 11/2011 Delgado ..... A45C 9/00 206/549
D728,222 S * 5/2015 Richards ..... D3/232
9,113,685 B2 8/2015 Iwai
D794,950 S * 8/2017 Gavriel ..... D3/243
9,756,918 B1 9/2017 Fernandez
9,901,152 B2 * 2/2018 Camurati ..... A44C 5/0007
10,244,841 B2 * 4/2019 Hayashi ..... A45C 3/06
D868,459 S * 12/2019 Fell ..... D3/235
2005/0076978 A1 * 4/2005 Canada ..... A45C 13/08 150/106
2006/0000858 A1 1/2006 Jung
2006/0027616 A1 2/2006 Ranen
2006/0151076 A1 * 7/2006 Koelmel ..... A45C 3/001 150/127
2007/0007314 A1 1/2007 Lin
2007/0194072 A1 * 8/2007 Guzinski ..... A41D 15/04 224/576
2012/0187138 A1 * 7/2012 Vasquez ..... A45C 1/02 220/739
2012/0225235 A1 9/2012 Dorsch
2012/0280010 A1 11/2012 Azcarate Leturia
2013/0086774 A1 4/2013 Krasinski et al.
2013/0230679 A1 9/2013 Czerniel et al.
2014/0102929 A1 * 4/2014 Moellers ..... A45C 11/18 206/425
2017/0042313 A1 2/2017 Brammer
2017/0202323 A1 * 7/2017 Johnson ..... A45C 3/001

* cited by examiner

SHOULDER STRAP ASSEMBLY FOR A BAG

CROSS-REFERENCE TO RELATED APPLICATION

This application claims the benefit of priority of U.S. provisional application No. 62/900,027, filed 13 Sep. 2019, the contents of which are herein incorporated by reference.

BACKGROUND OF THE INVENTION

The present invention relates to handbag accessories and, more particularly, a shoulder strap assembly for bags supported on the shoulder.

Shoulder bags, handbags, purses and the like are ubiquitous, essentially necessities for a substantial portion of the human population. Shoulder bags, however, tend to swing forward and/or fall off the shoulder when a user bends down or forward, or even when the user is moving briskly. This tendency is due to the attachment of the shoulder strap to the shoulder bag/purse, and the resulting orientation of the strap to the body of the shoulder bag.

As can be seen, there is a need for a shoulder strap assembly for shoulder-supported bags adapted to prevent the shoulder bag from falling off the shoulder. The shoulder strap embodied in the present invention is attached along an inside, peripheral portion of each side of the shoulder bag in a tri-para-planar alignment with the bag material, including flap portion of the bag material. Such attachment forms and enclosure with an upward-facing opening. As a result, when the flap portion of the bag material is folded over the upward-facing opening, the flap portion twists the distal ends of the shoulder straps in opposite directions, forming a predetermined curvature at the apex of the shoulder strap. The predetermined curvature faces the direction of the flap, and so if the shoulder bag is worn with the flap facing the wearer, the predetermined curvature conforms to the shoulder of a wearer, causing the shoulder bag to pull and/or lean toward the body of the wearer, and so preventing the shoulder bag from falling off the shoulder. The shoulder strap also causes the shoulder bag to conform to the body, keeping the shoulder bag close under the user's arm. As a result, the associated shoulder bag will not fall off the shoulder when the user bends down like traditional handbags would. Additionally, the present invention can be created with only two separate planar sheets of material along with joining material.

SUMMARY OF THE INVENTION

In one aspect of the present invention, a shoulder bag assembly including the following: a planar body material having a body width shared by coextensive first and second portions thereof; a planar strap material having a length at least one and a half times that of the body width; the first portion folded over the second portion sandwiching one of two distal ends of the planar strap material between each peripheral edge of said body width, respectively; and the first and second portions joined at each peripheral edge of said body width, defining a tri-para-planar arrangement of the first and second portions and the planar strap material; an enclosure defined by the first and second portions joined at each peripheral edge of said body width; and an opening of the enclosure defined by the first and second portions and the planar strap material; and a flap portion extending lengthwise from the first portion; the flap portion sharing the body width; and the flap portion movable between uncovering and covering the opening, wherein in covering the opening the flap portion rotates the planar strap material about both distal ends, but in opposing directions, respectively, so that an apex of the planar strap material is rotated seventy-five to one-hundred and five degrees relative to the tri-para-planar arrangement.

In another aspect of the present invention, a method of making a shoulder bag assembly includes the following: providing the planar body material; providing the planar strap material; folding the planar body material so that one of two distal ends of the planar strap material is sandwiched between each peripheral edge of said body width, respectively; and joining at each peripheral edge of said body width, defining a tri-para-planar arrangement of the first and second portions and the planar strap material.

In yet another aspect of the present invention, a method of making a shoulder bag assembly from one sheet of material includes the following: providing the one sheet of material in a rectangular shape; cutting along a length of the rectangular shape just inward of an associated edge, thereby creating the planar strap material and the planar body material having the body width; folding the planar body material so that one of two distal ends of the planar strap material is sandwiched between each peripheral edge of said body width, respectively; and joining at each peripheral edge of said body width, defining a tri-para-planar arrangement of the first and second portions and the planar strap material.

These and other features, aspects and advantages of the present invention will become better understood with reference to the following drawings, description and claims.

DETAILED DESCRIPTION OF THE INVENTION

Figure 1:
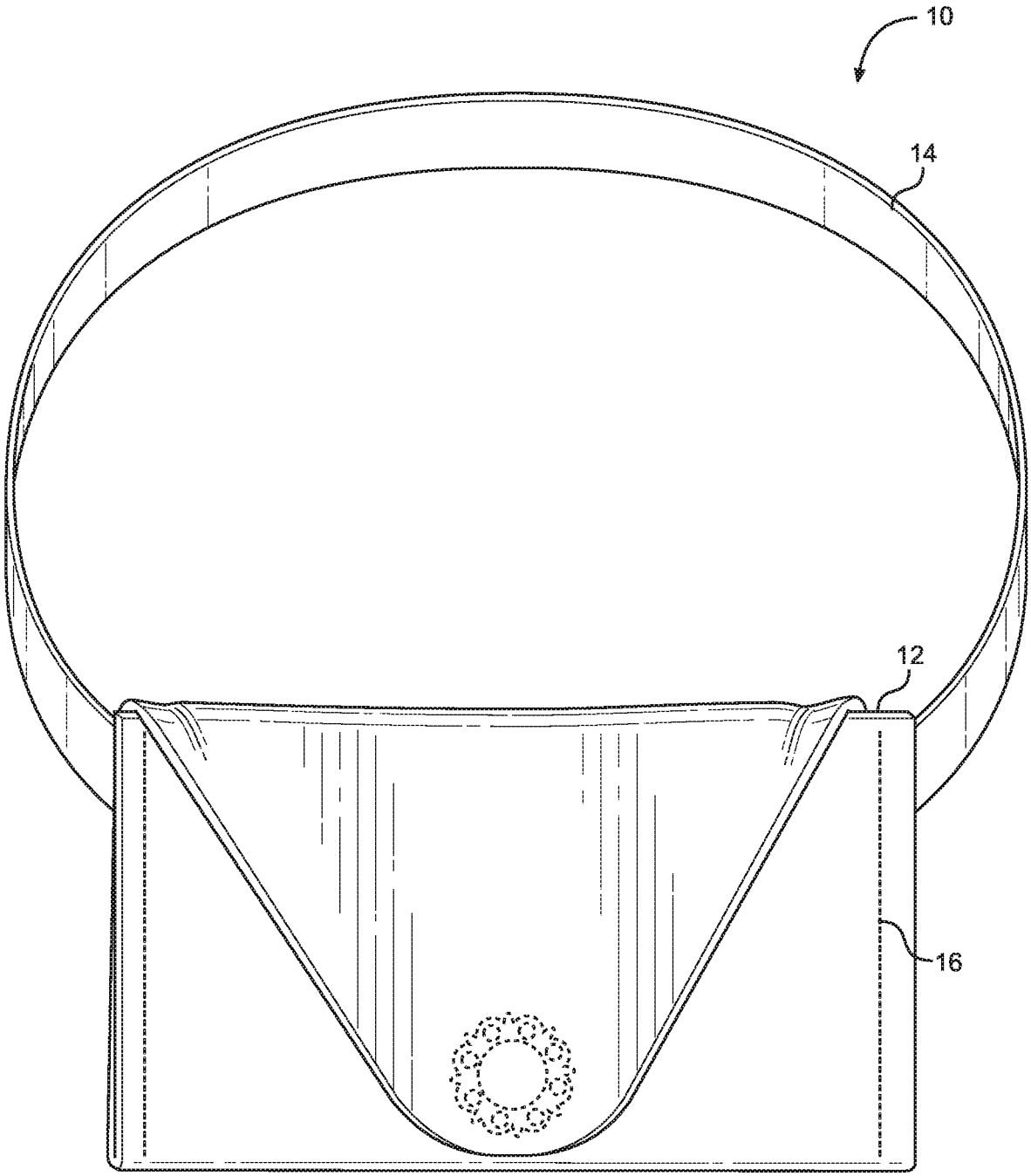
FIG. 1 is a perspective view of an exemplary embodiment of the present invention.
Figure 2:
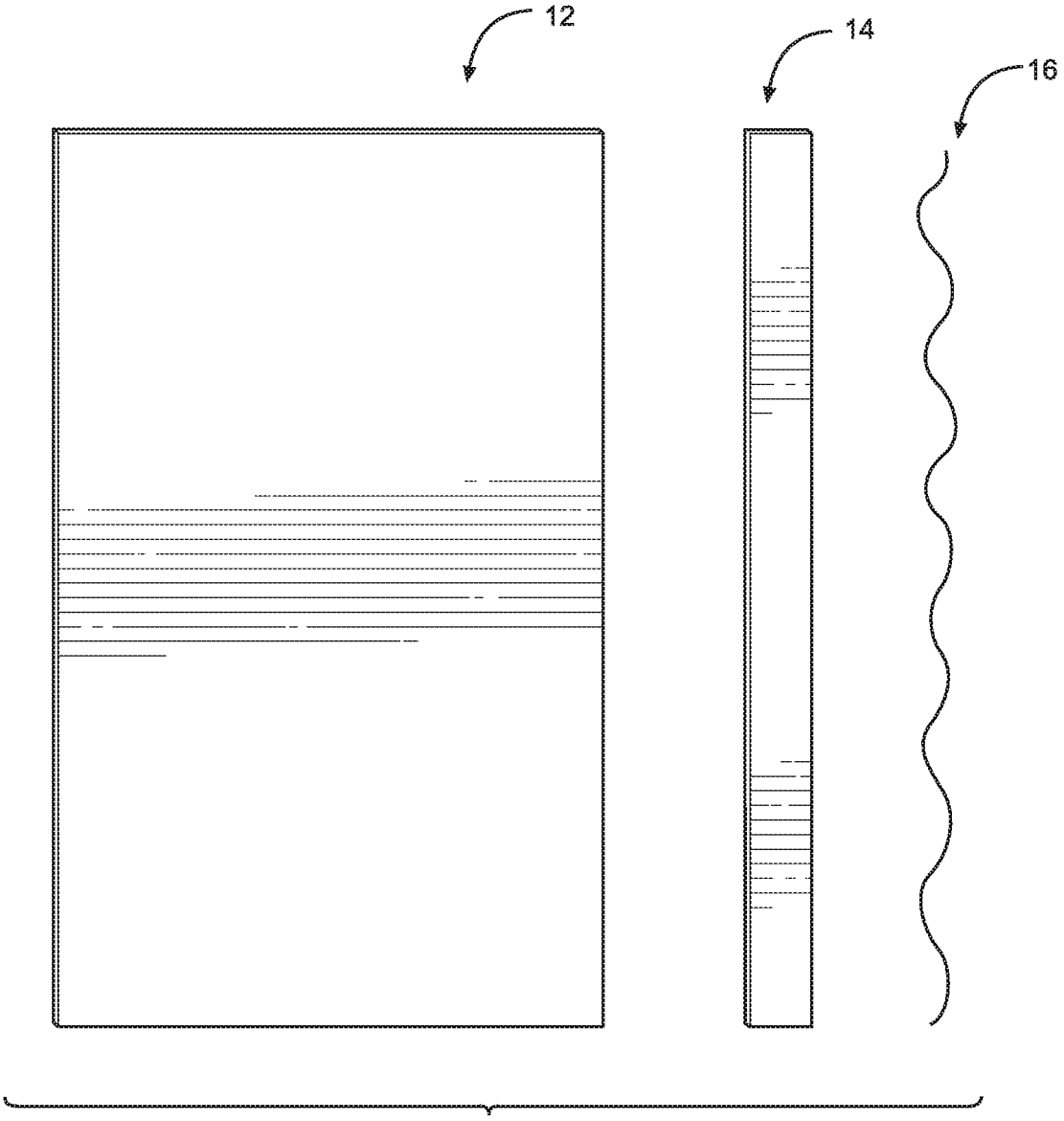
FIG. 2 shows elevation views of exemplary components of the present invention, wherein a body length of the shoulder bag/body material 12 and a strap length of the strap material 14 extends vertically in the Figure, the body length and the strap length can be approximately equal, and wherein a width of the body material extends horizontally.
Figure 3:
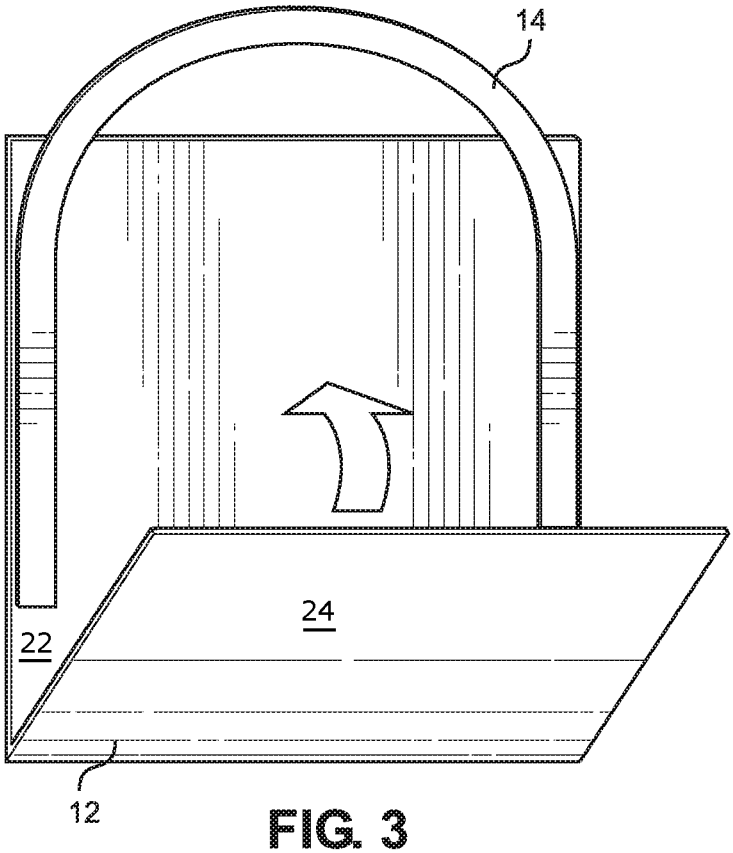
FIG. 3 is a perspective view of an exemplary embodiment of the present invention shown in an unassembled condition being manufactured.
Figure 4:
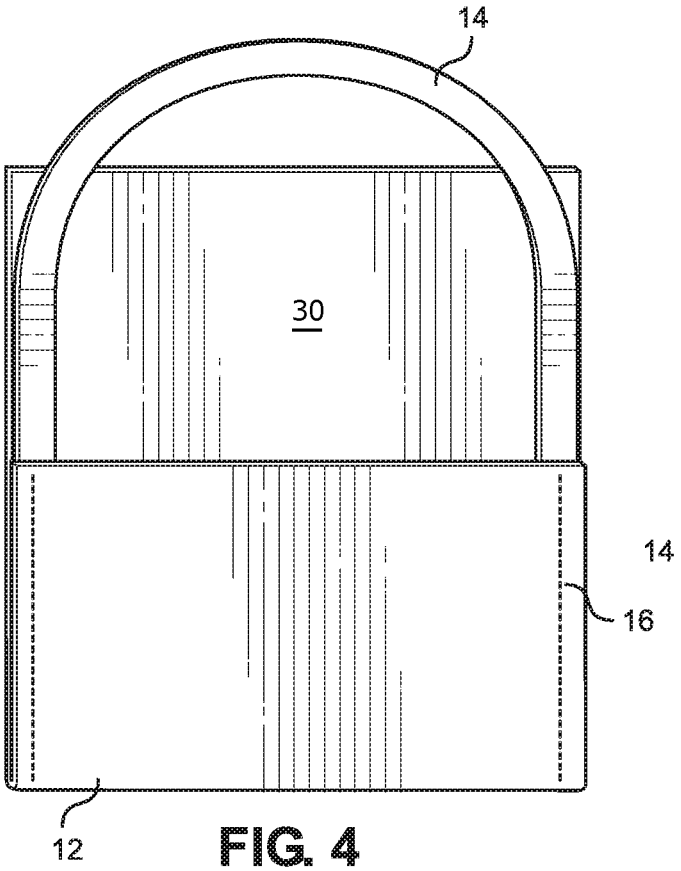
FIG. 4 is a perspective view of an exemplary embodiment of the present invention shown in an unassembled condition being manufactured.

The following detailed description is of the best currently contemplated modes of carrying out exemplary embodiments of the invention. The description is not to be taken in a limiting sense, but is made merely for the purpose of illustrating the general principles of the invention, since the scope of the invention is best defined by the appended claims.

Broadly, an embodiment of the present invention provides a shoulder strap assembly for shoulder-supported bags. The shoulder strap assembly is manufactured to provide a tri-para-planar alignment of the strap and the folded body material that forms the enclosure of the bag. The folded body material includes a coextensive flap portion that folds over an opening of the enclosure. In certain embodiments, when folded over, the flap portion twists each fixed end of the shoulder strap, in opposite directions. The twist amounts to rotation of approximately ninety degrees about each fixed distal end relative to the shoulder strap's curved apex/midpoint, where a predetermined curvature if formed. This predetermined curvature may also be formed, without the flap portion, when the user slings the apex/midpoint of the shoulder strap over their shoulder. The predetermined curve causes the shoulder bag to pull and/or lean toward the body of the wearer, preventing the associated shoulder bag from falling off the shoulder. The tri-para-planar alignment and resulting predetermined curvature of the apex of the shoulder strap also causes the shoulder bag to conform to the body, keeping the shoulder bag close under the user's arm.

It should be understood by those skilled in the art that the use of directional terms such as upper, lower, upward, downwardly, top, left, right and the like are used in relation to the illustrative embodiments as they are depicted in the figures, the upward direction (or upper) being toward the top of the corresponding figures, downward direction being toward the bottom of the corresponding figures.

Referring to FIGS. 1 through 5, the present invention may include a method of manufacturing a shoulder strap assembly 10 for a shoulder bag that results in an advantageous predetermined curvature at the apex or midpoint of the shoulder strap 14. The method may include shoulder bag material 12, strap material 14, and heavy-duty threading 16. The shoulder bag and strap material 12 and 14 may be leather, nylon or any sufficiently durable material—e.g., fabric, metallic, plasticized material—to form a shoulder bag that functions in accordance with the disclosure herein. The heavy-duty threading 16 may be any joining element for joining to objects together, including but not limited to adhesives.

A method of manufacturing the shoulder strap assembly 10 includes the following steps. Step A: the shoulder bag material 12 may be folded over onto itself defining two portions occupying parallel adjacent planes, a first portion 22 and second portion 24. The first portion 22 may coextensive with the second portion 24 but for a flap portion 30. The inner surfaces of the two portions 22 and 24 face each other. These inner surfaces define an inside portion of the shoulder strap assembly 10 enclosure. Step B: the strap material 12 may be inserted into the inside portion along a peripheral portion of the inner surface of each of the two portions 22 and 24. Step C: the heavy duty threading 16 may be used to sew together the two opposing peripheral portions of the two portions 22 and 24, sandwiching the distal ends of the strap material 14 therebetween. This sandwiched condition, illustrated in FIG. 4, causes the strap material 14 to be pinned at each distal end so that the shoulder strap material 14 and the two portion 22 and 24 are in three parallel, adjacent planes, or in the words of the inventor, in a "tri-para-planar" condition. The threading 16 provides the attachment points of the distal ends.

Figure 5:
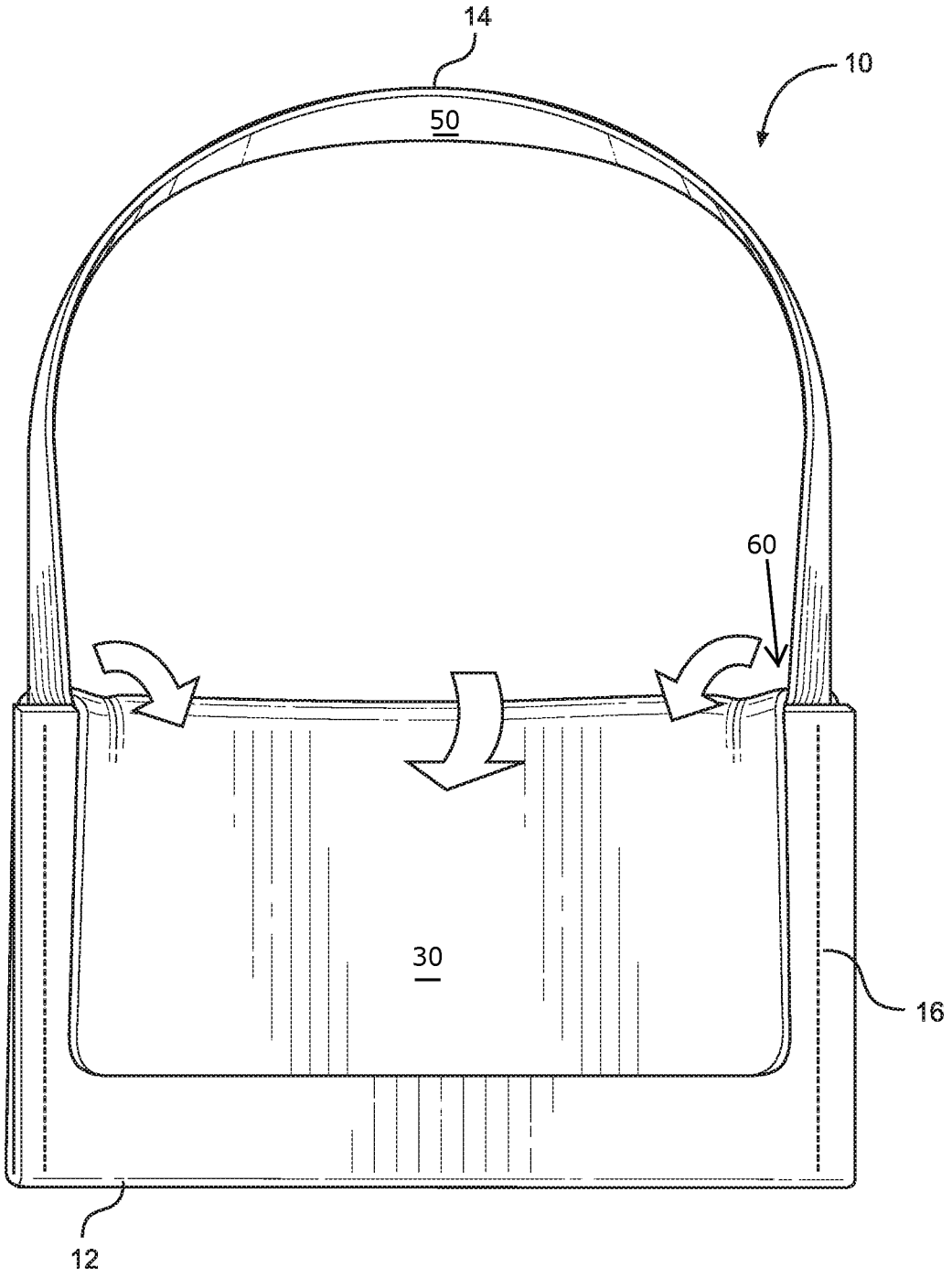
FIG. 5 is a perspective view of an exemplary embodiment of the present invention shown in an assembled condition.

In certain embodiments, the flap portion 30 of the first portion 22 (occupying, in a flat condition, one of the three parallel adjacent planes of the tri-para-planar arrangement), is folded over the second portion 24, as illustrated in FIG. 5, the flap portion 30 urges the shoulder strap 14 to twist or rotate about each fixed distal end in opposing directions. This happens at a twisting junction 60.

The twist of each distal end/attachment point relative to the curved apex/midpoint of the shoulder strap material 14 is approximately ninety degrees. This results in a predetermined curvature 50 at the apex that faces the same direction as the flap portion 30, which when loaded onto a shoulder causes the shoulder bag to pull and/or lean toward the body of the wearer, and so preventing the associated shoulder bag assembly 10 from falling off the shoulder. The predetermined curvature 50 faces the direction of the flap portion 30, so when the flap portion 30 faces the user, the shape and orientation of the shoulder strap material 14 the associated shoulder strap assembly 10 on the user's shoulder.

It should be understood that, in some embodiments, the flap portion 30 need not effectuate the predetermined curvature 50, but rather the user does by twisting the shoulder strap material 14 from the tri-para-planar arrangement in order to don the strap material on their shoulder.

In one embodiment, the method of manufacturing the shoulder strap assembly 10 may include the following steps: Step 1, laying the shoulder bag material 12—which in certain embodiments, may have a length and height of 12"×16"; Step 2, folding ⅓ of the shoulder bag material 12 up from bottom, wherein the strap material 14 size may be 18" to 24" long and 1½" to 2" wide; Step 3, placing two inches of strap material 14 between the shoulder bag material 12 on the left side, along the periphery of the inside portion; Step 4, placing two inches of strap material 20 between shoulder bag material 12 on the opposing right side, along the opposing inside, peripheral portion; Step 5, sewing the left side of the shoulder bag material 12 together from bottom to top of shortest piece of shoulder bag material 12 keeping the strap material 14 between the two portions 22 and 24 of shoulder bag material 12, along the inside portion; Step 6, sewing the right side of the shoulder material 12 together from bottom to top of shortest piece of the shoulder bag material 12, similar to the immediately previous step; and Step 7, folding the flap portion 30 of the shoulder material 12 over to the second portion 24, as illustrated in FIG. 5, to complete the shoulder bag/purse shoulder strap assembly 10, and form the predetermined curvature at the apex of the shoulder strap material 14. If unaltered, the flap portion 30 causes, at the twist junction 60, the shoulder strap material 14 to rotate about each distal end, in opposite directions, thereby forming the predetermined curve 50 that faces the same direction as the folded over flap 30, and so the user can wear the shoulder strap assembly 10 with the flap portion 30 facing their body.

A metal or plastic slot could be added to the sides along the periphery of the inside portion to make an interchangeable strap material 14, and/or snaps or other detachable fasteners could be added between the layers, enabling a removably attachment between them, and so allowing for an interchangeable strap.

It should be understood, of course, that the foregoing relates to exemplary embodiments of the invention and that modifications may be made without departing from the spirit and scope of the invention as set forth in the following claims.

What is claimed is:

1. A shoulder bag assembly, comprising:

a planar body material having a body width shared by coextensive first and second portions thereof;

a planar strap material having a length at least one and a half times that of the body width;

the first portion folded over the second portion sandwiching one of two distal ends of the planar strap material between each peripheral edge of said body width, respectively; and the first and second portions joined at each peripheral edge of said body width, defining a tri-para-planar arrangement of the first and second portions and the planar strap material.

2. The shoulder bag assembly of claim 1, further comprising:

an enclosure defined by the first and second portions joined at each peripheral edge of said body width; and an opening of the enclosure defined by the first and second portions and the planar strap material.

3. The shoulder bag assembly of claim 2, further comprising:

a flap portion extending lengthwise from the first portion;

the flap portion sharing the body width; and the flap portion movable between uncovering and covering the opening, wherein in covering the opening the flap portion rotates the planar strap material about both distal ends, but in opposing directions, respectively, so that an apex of the planar strap material is rotated seventy-five to one-hundred and five degrees relative to the tri-para-planar arrangement.

4. A method of making a shoulder bag assembly of claim 3, comprising:

providing the planar body material;

providing the planar strap material;

folding the planar body material so that one of two distal ends of the planar strap material is sandwiched between each peripheral edge of said body width, respectively; and joining at each peripheral edge of said body width, defining a tri-para-planar arrangement of the first and second portions and the planar strap material.

5. A method of making a shoulder bag assembly of claim 3 from one sheet of material, comprising:

providing the one sheet of material in a rectangular shape;

cutting along a length of the rectangular shape just inward of an associated edge, thereby creating the planar strap material and the planar body material having the body width;

folding the planar body material so that one of two distal ends of the planar strap material is sandwiched between each peripheral edge of said body width, respectively; and joining at each peripheral edge of said body width, defining a tri-para-planar arrangement of the first and second portions and the planar strap material.

* * * * *